US005143649A

United States Patent [19]

Blackledge et al.

[11] Patent Number: 5,143,649

[45] Date of Patent: Sep. 1, 1992

[54] PTC COMPOSITIONS CONTAINING LOW MOLECULAR WEIGHT POLYMER MOLECULES FOR REDUCED ANNEALING

[75] Inventors: Brian D. Blackledge, Taylorsville; William M. Rowe, Jr., De Kalb, both of Miss.

[73] Assignee: Sunbeam Corporation, Chicago, Ill.

[21] Appl. No.: 317,764

[22] Filed: Mar. 2, 1989

Related U.S. Application Data

[60] Division of Ser. No. 824,193, Jan. 30, 1986, Pat. No. 4,818,439, which is a continuation-in-part of Ser. No. 805,880, Dec. 6, 1985, abandoned.

[51] Int. Cl.[5] ..... H01B 1/06

[52] U.S. Cl. ..... 252/511; 524/495; 524/496; 264/105; 264/330; 264/331.15

[58] Field of Search ..... 252/511; 524/495, 496; 264/105, 331.15, 330

[56] References Cited

U.S. PATENT DOCUMENTS

| | | | |
|---|---|---|---|
| 4,237,441 | 12/1980 | Van Konynenburg et al. | 252/511 |
| 4,277,673 | 7/1981 | Kelly | 252/511 |
| 4,327,480 | 5/1982 | Kelly | 219/528 |
| 4,367,168 | 1/1983 | Kelly | 252/511 |
| 4,534,889 | 8/1985 | Van Konynenburg et al. | 252/511 |
| 4,658,121 | 4/1987 | Horsma et al. | 252/511 |
| 4,732,701 | 3/1988 | Nishii et al. | 252/511 |
| 4,775,778 | 10/1988 | Van Konynenburg et al. | 252/511 |
| 4,818,439 | 4/1989 | Blackledge et al. | 252/511 |
| 4,880,577 | 11/1989 | Okita et al. | 252/511 |

*Primary Examiner*—Josephine Barr

*Attorney, Agent, or Firm*—Marshall, O'Toole, Gerstein, Murray & Bicknell

[57] ABSTRACT

A revolutionary new semiconductive material having a sharp rise in electrical resistance at a predetermined maximum temperature with substantially no annealing necessary after extrusion to achieve an essentially constant resistance at room temperature. The PTC composition includes a finely divided conductive material, such as carbon black; a suitable semicrystalline polymer having a molecular weight distribution containing a sufficient number of relatively low molecular weight molecules to substantially eliminate annealing; and a suitable polymeric material providing a sufficient number of polar molecules for electrical conductivity. At least 9% by weight of the polymer molecules should be in the molecular weight range of 1,000 to 30,000, and particularly in the 5,000 to 23,000 range and the entire polymeric portion of the composite composition should have a number average molecular weight of 30,000 or less. Generally, the relatively low molecular weight molecules of the semicrystalline polymer (1,000 to 30,000 and particularly 5,000 to 23,000 M.W.) are included in an amount of 9% to 15% based on the total weight of polymer molecules in the composition.

14 Claims, 4 Drawing Sheets

PTC COMPOSITIONS CONTAINING LOW MOLECULAR WEIGHT POLYMER MOLECULES FOR REDUCED ANNEALING

CROSS REFERENCE TO RELATED APPLICATION

This application is a divisional of application Ser. No. 824,193, now U.S. Pat. No. 4,818,439, which is a continuation-in-part of application Ser. No. 805,880 filed Dec. 6, 1985, now abandoned.

FIELD OF THE INVENTION

The present invention is directed to a new and improved semiconductive material having a new and unexpected positive temperature coefficient of resistance with little or not annealing necessary after extrusion. More particularly, the present invention is directed to a new semiconductive material comprising a suitable polymer or blend of polymers having sufficient polymer molecules within the molecular weight range of 1,000 to 30,000, particularly in the 5,000 to 25,000 range to substantially eliminate the need for annealing (less than about 30 seconds). To achieve the full advantage of the present invention, the entire polymeric portion of the composition has a weight average molecular weight ($\overline{M}_w$) of 200,000 or less; a number average molecular weight $(\overline{M})_n$ in the range of 8,000 to 30,000 and particularly in the range of 8,000 to 23,000; and a polydispersibility ($\overline{M}_w/\overline{M}_n$) of 3 to 25, to essentially eliminate the need for an annealing oven. The particular carbon blacks most suitable for the semiconductive materials of the invention are essentially non-surface treated, have a mid-range value for dry volume resistivity, and have a nitrogen surface area A in $m^2$/gram greater than or equal to $1.75x+e^{x/37}$ where x is the DBP (dibutyl phthalate) absorption of the conductive material in cc/100 grams. The term "essentially non-surface treated" is herein defined as essentially non-chemically surface-treated (having essentially a non-oxidized surface) such that the pH of the carbon black is at least 4.0 and generally about 4.0 to 8.5. These non-surface treated blacks generally have a dry volatile content of about 3.0 or less and usually 2.5 or less. In accordance with an important feature of the present invention, the annealing needed for these materials is essentially zero (generally in the hundreds of milliseconds range) to achieve an essentially constant room temperature resistance so that a water quenching trough can be placed near the extruder with total elimination of the annealing oven and the attendant apparatus and manpower.

BACKGROUND OF THE INVENTION AND PRIOR ART

In about 1957 it was found that a ceramic material suitably loaded with conductive particles exhibited a sharp rise in electrical resistance at its Curie temperature and this phenomenon was named 37 The Positive Temperature Coefficient Phenomeon". Since 1957 extensive work has been done in Positive Temperature Coefficient (PTC) materials, particularly in the area of semicrystalline polymers loaded with finely divided conductive materials, particularly carbon black. This extensive work has been directed to improving the PTC phenomenon, especially for the purpose of providing a material having a built-in temperature control such that when the temperature of the material reaches a predetermined upper limit, the material becomes so resistive that it is essentially no longer conductive. This PTC phenomenon has been employed most efficiently in the electric blanket industry to provide a grid of body heat responsive PTC material surrounding a pair of conductive wires within a suitable blanket fabric material. The PTC materials have been developed with sufficient self regulating precision to provide electrode (conductor) surrounding material having the capacity to sense and deliver heat to all parts of the body in proportion to the heat requirements at any given time or location on the blanket without the necessity of internal blanket thermostats.

In spite of the extensive work that has been done in the area of new PTC materials, as evidenced by the scores of patents and articles directed to new compositions and new theories, the PTC phenomenon is one which is to date very poorly understood. A number of theories have been proposed in an attempt to explain the conductivity phenomenon for PTC materials. One theory is that the sharp positive temperature coefficient of resistance at a predetermined temperature results from thermal expansion of the polymer/finely divided conductor matrix. This theory is based on the proposal that the conductive filler is initially spread through the polymer in a network of conductive chains and as the material is heated, the conductive filler is spread out by thermal expansion until non-conductive behavior is experienced at the crystalline melting point. Others have theorized that the PTC phenomenon is due to a loss of conduction due to the more difficult electron tunneling through large intergrain gaps between carbon filler particles upon temperature rise. This theory is based upon the premise that the PTC phenomenon is due to a critical separation distance between carbon particles in the polymer matrix at the higher temperature. Still others have theorized that the PTC phenomenon is directly related to the polymer crystallinity for a given polymer so that increased crystallinity in a particular polymer causes increased PTC anomaly. For this last theory, however, there is no correlation between degrees of crystallization and the amount of PTC phenomenon that might be experienced in different polymers.

Much of the work directed to new PTC composite materials has been directed to particular conductive materials loaded into the polymer carrier and, in particular, to carbon blacks having particular reticulate structures, resistivities and/or particle sizes—see for example the Kelly U.S. Pat. Nos. 4,277,673; 4,327,480 and 4,367,168 and the Van Konynenburg et al Pat. No. 4,237,441. The patents and literature distributed by carbon black suppliers teach that the electrical conductivity of carbon blacks depends to a great extent upon the structure of the carbon blacks and the amount of surface treatment (oxidation). It is well known that higher reticulate structure grades impart higher conductivity than low reticulate structure grades and that surface treatment (volatile content) decreases conductivity. The reticulate structure of a carbon black is generally measured by its oil (dibutyl phthalate) absorption. Higher structure grades, which have a relatively large void area, absorb more oil than lower structure grades.

Carbon blacks consist of spherical particles of elemental carbon permanently fused together during the manufacturing process to form aggregates. These aggregates are defined by particle size and surface area; aggregate size or structure (reticulate structure); and surface chemistry. The particle size of carbon blacks is the size of the individual particles which are fused together during manufacture to make the aggregate and varies inversely with the total surface area of the aggregates. The surface area of carbon black aggregates is most commonly expressed in terms of nitrogen adsorption in $m^2$/gram using the B.E.T. (Brunauer, Emmet, Teller) procedure well known in the art. Carbon blacks having a relatively small particle size, and therefore a relatively high aggregate surface area, exhibit better conductivity or lower volume resistivity.

The size and complexity of the carbon black aggregates is referred to as "structure" or "reticulate structure". Low structure carbon blacks consist of a relatively small number of spherical carbon particles fused together compactly during manufacture to provide a relatively small amount of void space within the aggregate. High structure carbon blacks consist of more highly branched carbon a particle chains which, when fused together during manufacture, provide a large amount of avoid space within the aggregate. The structure level of carbon blacks is measured by its oil (dibutyl phthalate) absorption. Higher structure grades of carbon blacks absorb more oil than lower structure grades because of the larger avoid volume within the aggregates.

During the manufacture of carbon blacks, some oxidation naturally occurs on the surface of the aggregates resulting in the presence of chemisorbed oxygen complexes such as carboxylic, quinonic, lactonic and phenolic groups on the aggregate surfaces. Some carbon blacks are further surface treated to provide more chemisorbed oxygen on the aggregate surfaces. These surface treated carbon blacks can be identified by their low pH, less than 4.0 and generally in the range of about 2.0 to 3.0, and/or by measuring the weight loss of dry carbon black when heated to 950° C. This weight loss is referred to as "volatile content" and for surface treated carbon blacks, generally is at least 3.0 weight percent and generally in the range of about 5.0 to 10.0 weight percent. The degree to which carbon blacks impart some electrical conductivity (or lessen volume resistivity) to normally non-conductive plastics depends upon four basic properties of the carbon black: surface area, structure, porosity and surface treatment. Higher structure carbon blacks impart higher conductivity (lower volume resistivity) than lower structure grades because the long, irregularly-shaped aggregates provide a better electron path through the compound. Surface treatment, on the other hand, always causes the volume resistivity to be high (low conductivity) because the surface oxygen electrically insulates the aggregates.

One of the knowns about PTC polymeric composite materials is that the polymer must, in its final state, be partly crystalline in order to exhibit PTC behavior. Experimentation with amorphous polymers filled with conductive particles, such as carbon black, do not show any increase in resistance on heating. Polymeric matrix material having a sharp increase in resistance at a predetermined temperature (PTC material) to date have not been electrically conductive without an annealing period ranging from minutes to days. U.S. Pat. No. 3,861,029 points out that polymeric materials loaded with a sufficiently high percentage of carbon black to produce a conductive material when first prepared exhibit inferior flexibility, elongation, crack resistance and undesirably low resistivity when brought to peak temperatures. Accordingly, it has been necessary to limit the carbon black content of the polymeric matrix and to anneal (heat treat at or above the crystalline melting point) for a period of time to slowly develop crystallinity until the material reaches a constant room temperature resistance. In order to provide an adequate degree of crystallinity in the polymeric matrix materials, after melting and extrusion, it has been necessary to anneal the material for a sufficient time in order to allow the required translational and conformational reorganizations necessary to fit the molecules into the properly ordered crystalline lattice structure of the polymeric material.

It is also known that the use of highly conductive carbon blacks results in a material requiring rigorous annealing to achieve a constant resistance, or results in compositions having resistances too high to be of practical use. The prior art compositions, however, have required the highly conductive carbon blacks to achieve a composition having sufficient electrical conductivity and exhibiting PTC behavior. As disclosed in the Kelly U.S. Pat. Nos. 4,277,673 and 4,327,4890 and 4,367,168, the use of highly resistive (essentially non-conductive) carbon blacks such as the surface treated Mogul L and Raven 1255, when used in the range of 5 to 15%, substantially reduces the necessary annealing time down to a period of about two to three hours in some cases.

It has been found that the selection of polymers having a suitable number of relatively low molecular weight molecules, together with a carbon black having essentially no chemical surface treatment (oxidation), as indicated by a pH of at least 4.0, and generally in the range of 5.0 to 8.5, and having a relatively low reticulate structure, as defined by the relation between nitrogen surface area and DBP absorption according to the following equation: $A \geqq 1.75x + e^{x/37}$ where A = nitrogen surface area in $m^2$/gram and x = DBP absorption in cc/100 grams, substantially eliminates the annealing time necessary for the PTC material to achieve a substantially constant room temperature electrical resistance.

SUMMARY OF THE INVENTION

In brief, the present invention is directed to a revolutionary new semiconductive material having a sharp rise in electrical resistance at a predetermined maximum temperature. This revolutionary new material exhibits a sharp positive temperature coefficient (PTC) of resistance at a predetermined temperature with substantially no annealing necessary after extrusion to achieve an essentially constant resistance at room temperature. The PTC composition includes a finely divided conductive material, such as carbon black; a suitable semicrystalline polymer having a molecular weight distribution containing a sufficient number or relatively low molecular weight molecules to substantially eliminate annealing; and a suitable polymeric material providing a sufficient number of polar molecules for electrical conductivity. To achieve the full advantage of the present invention, at least 9% by weight of the polymer molecules should be in the molecular weight range of 1,000 to 30,000, and particularly in the 5,000 to 23,000 range and the entire polymeric portion of the composite composition should have a weight average molecular weight ($\overline{M}_w$) of 200,000 or less; and a number average molecular weight ($\overline{M}_n$) of 30,000 or less. Generally, the relatively low molecular weight molecules of the semicrystalline polymer (1,000 to 30,000 and particularly 5,000 to 23,000

M.W.) are included in an amount of 9% to 15%, and particularly 9–12%, based on the total weight of polymer molecules in the composition. A higher amount of relatively low molecular weight molecules of the semicrystalline polymer can be included in the PTC materials of the present invention so long as the material remains structurally sound. These polymeric PTC materials are essentially non-conductive upon initial mixing since they contain about 25% or less carbon black. After holding the material at or above the melt temperature (annealing) for a period of less than 1 second, the materials exhibit excellent PTC and conduction characteristics. Accordingly, the annealing oven can be completely eliminated since sufficient annealing is completed after extrusion and before quenching. After quenching, the material is suitably cross-linked, such as by irradiation.

In accordance with an important feature of the present invention, the semicrystalline polymer include s a sufficient number of relatively low molecular weight molecules so that a sufficient percentage of the molecules of the semicrystalline polymer is mobile enough to permit unexpected rapid crystallization of the semicrystalline polymer after the extrusion of the other material shaping process so that thermal structuring (annealing) of the material is essentially eliminated. In accordance with the principles of the present invention, the relatively low molecular weight semicrystalline polymer molecules easily and rapidly arrange into the necessary lattice structure through orderly chain packing, thereby unexpectedly reducing or eliminating additional thermal structuring of the material after the shaping or extrusion process. Unexpectedly, the mobility of the lower molecular weight portion of the semicrystalline polymer permits conductive particle loaded polymeric material to achieve a constant room temperature resistance after shaping or extrusion, with essentially no annealing. It has been found that semicrystalline polymers having a weight average molecular weight ($\overline{M}_w$) of about 200,000 or less; a number average molecular weight ($\overline{M}_n$) of 30,000 or less, and particularly less than 23,000; and a polydispersibility ($\overline{M}_w/\overline{M}_n$) of 3–25 rapidly crystalize while essentially eliminating post-shaping annealing.

In accordance with an important feature of the present invention, the carbon blacks incorporated into the compositions of the present invention are extremely mobile to permit rapid movement of the carbon particles during crystallization. The mobility of the carbon blacks provides new and unexpectedly rapid crystallization after an extrusion or other material shaping process resulting in unexpectedly short thermal structuring (annealing) times. The carbon blacks defined herein have been found to be capable of easily moving into the amorphous regions of the polymer portion of the composition of the present invention for the purpose of being disposed, quickly, sufficiently close to one or more polar moieties of the amorphous, polar material for interaction with the polar moieties to achieve excellent electrical conduction while exhibiting PTC behavior.

Without being limited to any particular theory as to the carbon-polar moiety interaction, it is believed that the carbon particles conduct electrons onto the polar moieties, e.g., carboxyl groups, of the amorphous polymer which then conduct electrons onto the crystal structure of the crystalline portion of the semicrystalline polymer resulting in electrical conductivity. Further, the mobility of the preferred carbon blacks defined herein is extremely important in the crystallization process so that the carbon particles are capable of rapid movement away from the forming crystallites to permit the relatively unhindered, rapid formation of a regular crystal lattice structure through orderly chain packing, thereby substantially lessening the required annealing time.

In accordance with one important embodiment of the present invention, the finely divided conductive particles as non-surface treated (essentially non-oxidized, having a pH of at least 4.0 and generally of at least 5.0) carbon black having a low reticulate structure; an intermediate dry volume resistivity and a low DBP absorption defined by the relationship between $N_2$ surface area and DBP (dibutyl phthalate) absorption in accordance with the equation: $A \geqq 1.75x + e^{x/37}$ where A is the nitrogen surface area in $m^2$/gram and x is the DBP absorption in cc/100 grams.

Accordingly, an object of the present invention is to provide a new and improved semiconductive composite polymer/conductive particle material wherein the semicrystalline polymer includes a sufficient number of relatively low molecular weight molecules to provide sufficient semicrystalline polymer mobility to permit rapid crystallization of the semiconductive polymer to achieve a material having a constant resistance at room temperature with an unexpectedly short annealing period.

Still another object of the present invention is to provide a new and improved semiconductive composite polymer containing a crystalline or semi-crystalline polymer; a polymeric material containing polar molecules; and dispersed, finely divided conductive particles requiring substantially no annealing after extrusion.

Another object of the present invention is to provide a new and improved semiconducting composite polymeric material exhibiting a sharp positive temperature coefficient of resistance at a predetermined temperature.

Another object of the present invention is to provide a new and improved PTC material including a polymer having at least 10% crystallinity containing dispersed conductive particles, particularly carbon black, including sufficient low molecular weight semicrystalline polymer molecules in the molecular weight range of 1,000 to 30,000, and particularly in the 5,000 to 23,000 range to provide new and improved electron tunneling through polymer molecules for sufficient conductance with substantially no annealing necessary after extrusion.

Still another object of the present invention is to provide a new and improved polymer composite composition including finely divided carbon black, dispersed throughout a semicrystalline polymer wherein the carbon black is essentially non-surface treated, having a pH of at least 4.0, and generally in the range of 5.0 to 8.5, wherein the nitrogen surface area A and DBP absorption are related in accordance with the following equation: $A \geqq 1.75x + e^{x/37}$ where A is the nitrogen surface area in $m^2$ gram and x is the DBP absorption in cc/100 grams.

Another object of the present invention is to provide a new and improved PTC material including a partially crystalline polymer having a sufficiently low number average molecular weight and containing dispersed conductive carbon black particles having a pH of at least 4.0 wherein the nitrogen surface area and DBP absorption are related in accordance with the equation $A \geqq 1.75x + e^{x/37}$ wherein A = nitrogen surface area in $m^2$/gram and x = DBP absorption in cc/100 grams, to provide sufficient conductivity with essentially no annealing after extrusion or other shaping process.

Still another object of the present invention is to provide a new and improved PTC material including finely divided conductive particles dispersed in a polymer having a weight average molecular weight ($\overline{M}_w$) of about 200,000 or less; a number average molecular weight ($\overline{M}_n$) of less than about 30,000, and generally less than 25,000; and a polydispersibility ($\overline{M}_w/\overline{M}_n$) of 3–25.

The above and other objects and advantages of the present invention will become apparent from the following detailed description of the preferred embodiment taken in conjunction with the drawings.

DETAILED DESCRIPTION OF THE PREFERRED EMBODIMENT

Figure 1:
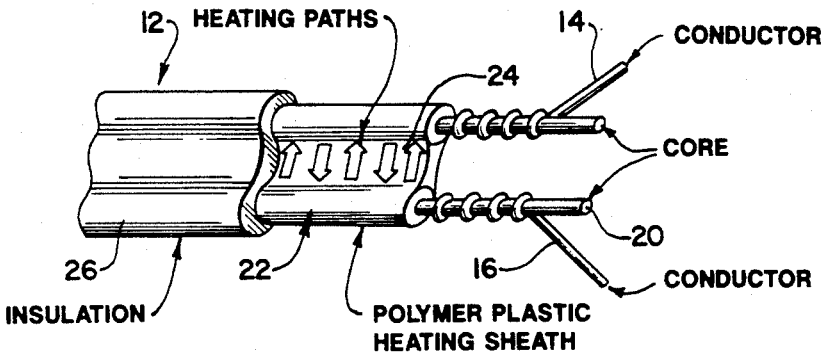
FIG. 1 is an enlarged, elevated, partially broken away view of the heating cable of the present invention.

The polymer component used in the semiconductive materials of the present invention may be a single polymer or a mixture of two or more different polymers. The polymers should have at least 10% crystallinity, and since greater crystallinity favors more intense PTC bahavior, its crystallinity is preferably about 15% to 25% based on the polymer volume. Suitable polymers include polyolefins, especially polymers of one or more α-olefins, e.g., polyethylene, polypropylene and ethylene, propylene copylmers. Excellent results have been obtained with polyethylene, preferably low density polyethylene.

In addition to the semicrystalline polymers, a material, e.g., polymer, copolymer or terpolymer, providing a sufficient number of polar groups, e.g., carboxyl groups, is provided in an amount of about 5% by weight to about 20% by weight of the composition to provide sufficient conductivity to the composition. The conductivity of the semiconductive materials of the present invention no longer increases at polar polymer loadings above about 20% by weight, although more than 20% by weight of the polar polymer can be included so long as consistent with the structural (strength) requirements of the material. Materials having more than one polar group, e.g., di-carboxyls, provide the necessary conductivity to the materials at lower loadings, e.g., 2to 3% by weight of the composition, while polymer shaving a single polar group such as ethylene ethyl acrylate, generally are required in an amount of at least about 5% by weight and preferably 10% to 20%. Suitable examples of polar polymers include copolymers of one or more α-olefins, e.g., ethylene with one or more polar copolymers, e.g., vinyl acetate, arcylic acid, ethyl acrylate and methyl acrylate such as ethylene vinyl acetate, ethylene ethyl acrylate, ethylene acrylic acid and its metal (e.g., Na, Zn) salts; terpolymers of ethylene acrylic acid and or its metal salts and methacrylic acid, polyethylene oxide, polyvinyl alcohol; polyarylenes, e.g., polyarylene ether ketones and sulfones and polyphenylene sulfide; polyesters, including polylactones, e.g., polybutylene terephthalate, polyethylene terephthalate and polycaprolactone; polyamides; polycarbonates; and fluorocarbon polymers, i.e., polymers which contain at least 10%, preferably at least 20%, by weight of fluorine, e.g., polyvinylidene fluoride, polytetrafluoroethylene, fluorinated ethylene/propylene copolymers, and copolymers of ethylene and a fluorine-containing comonomer, e.g., tetrafluoroethylene, and optionally a third comonomer. In processing, it is preferred to mix the carbon blacks into the polar polymer prior to adding the semicrystalline polymer to the composition.

Semicrystalline polymers include clusters of small crystallites as well as a significant faction of unordered, amorphous regions. For crystallization to occur, the polymer molecule must have a regular chain structure that permits the formation of a regulator crystal lattice through orderly chain packing. Bulky, protruding molecular branching, for example, that is found in all commercial low density polyethylenes, interfere with crystallization by hindering the main polymer chain from arranging into the required crystalline lattice structure. Without being limited to any particular theory of the present invention, small, linear molecules, polyethylene for example, when cooled to the appropriate temperature, crystallize quickly forming small crystallites. Larger and more complex polymer molecules, like high molecular weight, branched polyethylene must undergo a number of structural changes to pack into the required crystal lattice structure. Accordingly, the higher molecular weight, more branched polymer molecules have a slower rate of crystallization and, in some instances, the degree of crystallization is inhibited to an extent such that only a rigid, amorphous polymeric matrix is formed on cooling.

It has been found that the inclusion of a low molecular weight molecule fraction in the polymeric material in the matrix results in a semicrystalline polymer exhibiting at least two revolutionary new and unexpected features: (1) the resulting polymer blend requires essentially no annealing (generally less than one second held above the melt temperature), and (2) the use of conductive particles dispersed throughout the polymer matrix having a low reticulate structure and essentially non-oxidized surface, for example, a low structure, non-surface treated carbon black including all those falling on or above and to the left of the curved line of the drawing of FIG. 3, results in a material requiring essentially no annealing with elimination of the annealing oven.

As indicated in the prior art, and particularly the Kelly U.S. Pat. Nos. 4,327,480, 4,277,673 and 4,367,168, all of the prior art teaching relating to the compound of a PTC material, with the exception of the Kelly patents, have dealt specifically with low volume resistivity, high reticulate structure carbon blacks for the purpose of achieving sufficient carbon particle-to-particle conductivity. As disclosed in the Kelly patents, it was found that the inclusion of about 5 to 15% by weight of a low conductivity (high dry volume resistivity) carbon black material having a 5% volatile content (Mogel L or Raven 1255) results in better conductivity.

Figure 3:
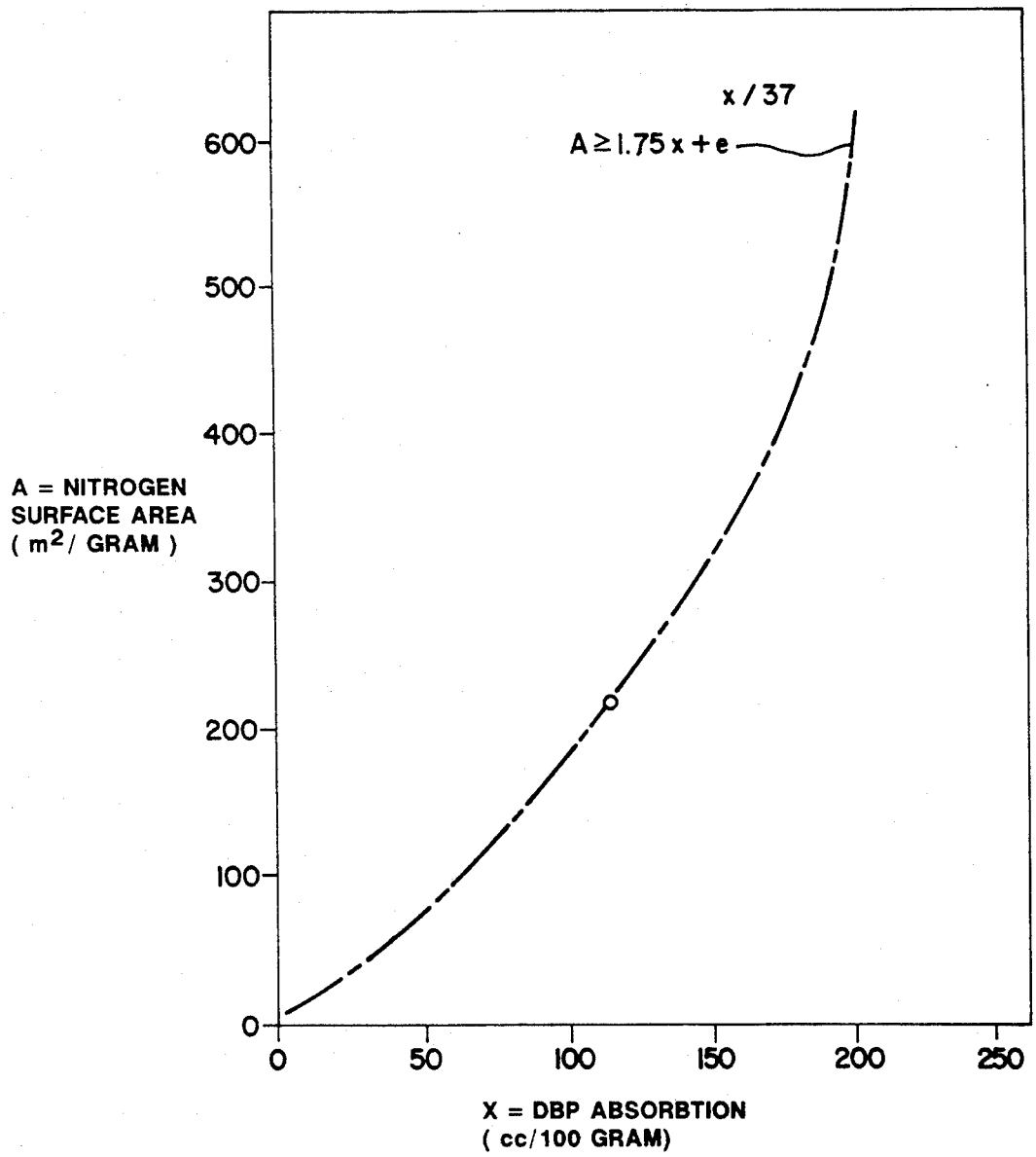
FIG. 3 is a graph of $N_2$ surface area vs. DBP absorption for the preferred carbon blacks incorporated into the polymeric matrix compositions of the present invention.

To achieve the full advantage of the present invention, low structure, medium conductivity, low volatile content carbon blacks are incorporated in the polymer compositions of the present invention. Such carbon blacks eliminate the need for an annealing oven and heretofore have not been used with the prior art polymers to obtain suitable PTC materials. These carbon blacks have a pH of at least 4.0 and generally in the range of 5.0 to 8.5; a dry volatile content less than or equal to 3.0% and preferably less than 1.5%, and as shown in FIG. 3 of the drawings, are defined by nitrogen surface area and DBP absorption as falling on or above and to the left of the curved line represented by the equation $A \geqq 1.75\ x + e^{x/37}$ where A is the carbon black nitrogen surface area in $m^2$/gram and x is the DBP absorption in cc/100 grams. It should be understood that other more or less conductive, higher surface area carbon blacks can be used with the polymeric materials of the present invention, but to achieve the full advantage of the present invention, the polymer matrix composition should include 4 to 25%, and particularly 10 to 20% of conductive particles having a pH of at least 4.0 and a nitrogen surface area and DBP absorption such that the material falls on or above and to the left of the curved line of FIG. 3.

The semiconductive polymer matrix composition containing dispersed conductive particles forming the PTC material of the present invention preferably contains an antioxidant in an amount of, for example, 0.5 to 4% based on the volume of the polymeric material, as well known in the art, for example, a 1,3-di-t-butyl-2-hydroxyl phenyl antioxidant. The antioxidant prevents degradation of the polymer during processing and during aging. The matrix also can include conventional components such as non-conductive fillers, processing aids, pigments and first retardants. The matrix is preferably shaped by melt-extrusion, molding or other melt-shaping operation. Excessive working of the polymer matrix composition should be avoided to prevent excessive resistivity in the material. In appears that restricting the work done on the polymeric matrix material allows the formation of a material conductive to the tunneling conduction mode. If the material is slightly underworked, additional working at the extruder will enhance the conduction properties. It appears from the data collected on the polymeric compositions of the present invention that specific work of 0.1 to 0.15 horsepower-hour per pound of material is a particularly advantageous operating range for the compound equipment. In accordance with a preferred embodiment, external heat should be supplied such that the polymer matrix mix will discharge from the extruder, after the appropriate mixing time, at about 335° F.

In the mixing step, the carbon black and any other components are incorporated into polymeric materials using a high-shear intensive mixer such as a Banbury Mixer. The material from the Banbury Mixer can be pelletized by feeding it into a chopper and collecting the chopped material and feeding it to a pelletized extruder. The pelletized mix can be used for subsequent casting of the mix or for extrusion onto appropriate electrodes to produce heating wire, sensing devices, and the like, and thereafter the product is provided, if desired, with the extrusion of a suitable insulating jacket. In accordance with an important advantage of the present invention, it is unnecessary to provide a form-retaining jacket on the materials of the present invention after extrusion since the material requires essentially no annealing and can crystallize in less than one second without losing the shape imparted by the extruder.

After the polymeric matrix composition has been shaped, such as by extrusion, it is then cross-linked to immobilize the conductive particles dispersed throughout the polymer material. The cross-linking traps the conductive particles to prevent them from migrating, although there is some mobility in migration of the carbon particles during crystallization when it is believed that the conductive particles are swept into the amorphous regions of the semicrystalline polymeric material and particularly into any amorphous copolymer included with the polymeric matrix. Cross-linking not only immobilizes the carbon particles, but also cross-links the amorphous polymer molecules thereby immobilizing the crystalline portion of the polymer and the carbon black in proper position for electron tunnelling. The polymeric matrix preferably is cross-linked by irradiation. The cross-linking forms strong carbon-carbon bonds to effectively immobilize the free carbon particles in their positions at the time of cross-linking to prevent the formation of conductive carbon chains above the melt transition temperature.

To achieve the full advantage of the present invention, the polymer matrix material should be irradiated to a total dose that exceeds 20 Mrads., preferably at least 30 Mrads. The carbon black or other finely divided conductive particles, while necessary in order to produce a polymeric matrix having a sharp increase in resistance at a predetermined temperature, and to completely eliminate the annealing oven, appears to be a relatively minor although necessary conduction mode in the PTC materials of the present invention.

It is preferred to use in an amount of conductive particles less than about 25% by weight of the polymeric matrix. The composition of the present invention, containing possibly less carbon black loading than the materials of the prior art, have excellent properties of elongation, flexibility and crack resistance. Further, because the tunneling mode of electrical conductivity is the major mode of electrical conduction in the materials of the present invention, although the carbon black loading is relatively small, the material has good initial conductivity immediately after existing the extruder while also achieving very high resistance at the higher temperatures as necessary in accordance with the PTC phenomenon.

The polymeric matrix materials of the present invention are particularly useful for the manufacture of self limiting heating wire, for electric blankets and the like. Turning to the drawing, and initially to FIGS. 1 and 2, there is shown a suitable electric blanket, generally designated by numeral 10, containing heating wire, generally designated by numeral 12, manufactured with the polymeric matrix compositions of the present invention. As shown in FIG. 1, the heating wire contains a pair of spaced conductors 14 and 16 which may be suitably wrapped around core materials 18 and 20, respectively, as well known in the art.

Figure 2:
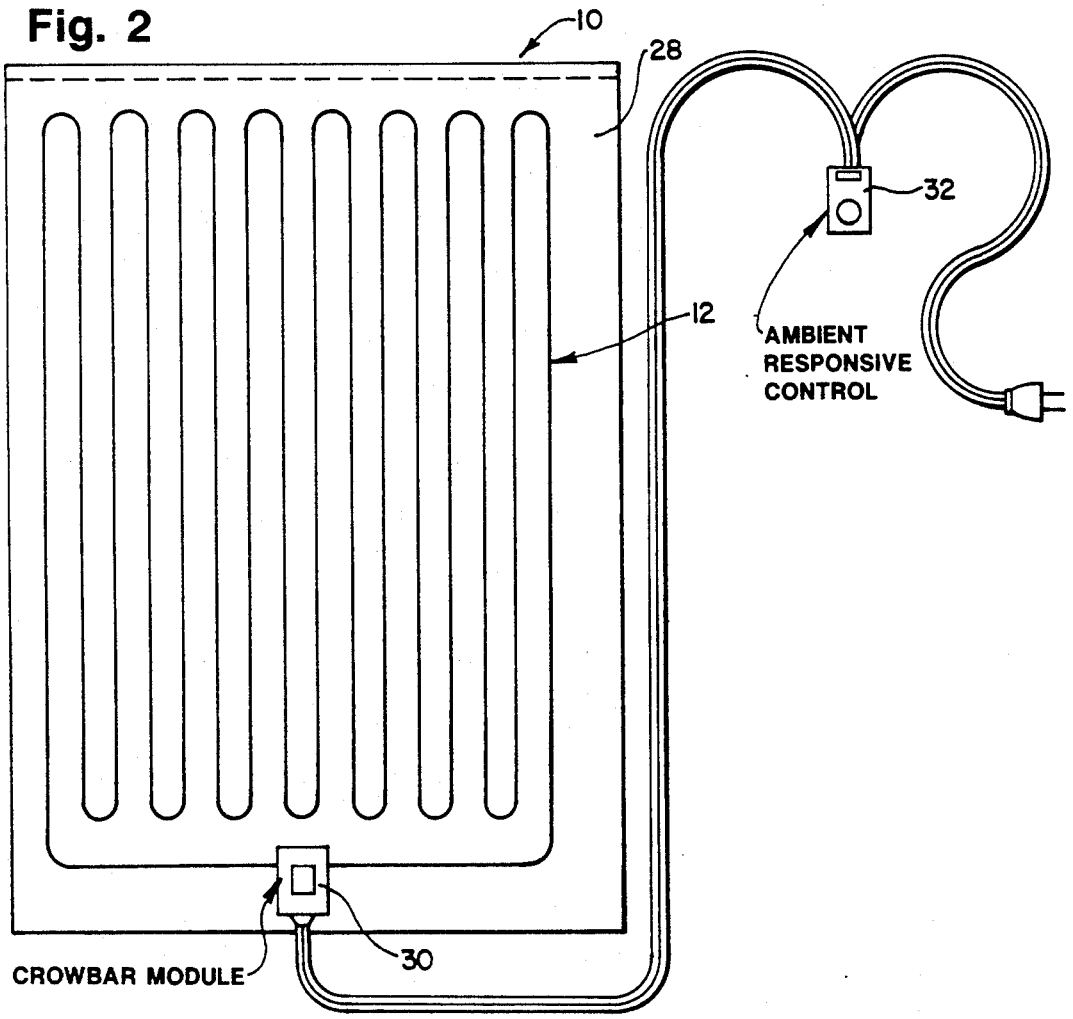
FIG. 2 is a broken away top view of an electric blanket containing the heating cable of the present invention.

Such heating wires exhibiting PTC characteristics are well known in the art and have extruded thereon (in accordance with standard extrusion techniques) the composition of this invention generally designated by reference numeral 22 in what is referred to as a "dumbbell" cross-section so as to cover the conductors 14 and 16, and cores 18 and 20 and provide a continuous interconnecting web 24 of polymeric matrix material forming heating paths, as shown in FIG. 1. A suitable insulating jacket or covering 26 is also extruded by conventional techniques over the full length of the heating cable 12. Cross-linking is effected preferably by irradiation immediately after extrusion. In accordance with an important and unexpected advantage of the present invention, proper selection of polymer or polymer blends together with proper selection of conductive particles enables total elimination of the annealing oven. As shown in FIG. 2, this heating cable 12 is disposed within a suitable fabric material, e.g. polyester and or acrylic fabric 28 provided with an electrically connected on-off switch 30 and an ambient responsive control 32.

After final cross-linking, and polymeric matrix material forming the ground wire or other configuration becomes relative insensitive to temperature in the melting range of most jacketing materials. Accordingly, fi the jacket is extruded around the polymeric matrix material at 200 to 300 feet per minute, there will be no problems with heat degradation. However, if the extrusion process is topped for any reason, the polymeric matrix material in the extruder cross head may undergo degradation.

In accordance with the present invention, various experiments were conducted with low density polyethylenes in order to determine whether a polymer having a weight average molecular weight ($\overline{M}_w$) of about 200,000 or less, and a relatively low number average molecular weight ($\overline{M}_n$) fraction would substantially decrease the annealing time necessary to achieve a substantially stable and constant room temperature resistance. Modern gel permeation chromatography (GPC) now permits accurate analysis of molecular weight distribution of polymers and two samples of Union Carbide DFD 6005 were analyzed and found to have weight average molecular weights ($\overline{M}_w$) of 139,000 and 124,000 and number average molecular weights ($\overline{M}_n$) of 34,800 and 30,000, respectively. Another low density polyethylene polymer USA 310-06 was also analyzed by GPC and two samples were found to have a $\overline{M}_w$ of 150,000 and 156,000 and a $\overline{M}_n$ of 22,600 and 23,400, respectively. It was found by GPC analysis that both polymers had a very similar molecular weight distribution for the middle half of the molecules, but Union Carbide 6005 included only 57% as many molecules in the high molecular weight region (top quarter) and, more importantly, only 55.2% as many molecules in the low molecular weight region (3,000 to 38,000 molecular weight). Further, it was found that the USA 310-06 contained three times as many low molecular weight molecules in the range of 3,000 to 6,000 as present in the Union Carbide 6005 polyethylene. It was found that extrusions of the USI 310-06 require substantially less annealing time than the Union Carbide 6005, and essentially no annealing time (250 milliseconds) when used with a properly selected carbon black, e.g., Regal 600 from Cabot.

These molecular weight data, coupled with the theory that crystallization rates are enhanced by the presence of low molecular weight polymer species, support the mechanism and reason why 310-06 polyethylene requires much shorter anneal times for similar conduction.

The molecular weight distribution of a standard PTC polymer composition was altered by loading the polymer with low molecular weight polyethylene and/or waxes. The PTC composition, having an initial volume resistivity of 1350 ohm-cm, was comprised of 48% Union Carbide DFD-6005, 20% alumina trihydrate, 16% Regal 660 carbon black, and 16% ethylene ethylacrylate copolymer. After loading the composition with both Eastman Kodak's C-10 Epolene (low molecular weight polyethylene) and a highly refined household paraffin, the PTC composition showed noticeable improvements in conduction. After loading the polyethylene PTC composition with 10% epolene, the volume resistivity of the PTC compounds were substantially reduced.

Experimental data indicates the existence of a preferred low molecular weight range that enhances the tunneling conduction mode of conductivity for polymer/finely divided conductor compositions. Experiments have shown that the amount of low molecular weight species can be altered by addition of low molecular weight molecules to a low density polymer, such as polyethylene, or any other semicrystalline polymer which exhibits PTC characteristics. Calculations show that after adding 10% Epolene low molecular weight polyethylene to a polyethylene/ethylene ethylacrylate composition containing a finely divided conductor, the number average molecular weight of the polymer in the matrix shifted from 34,800 to 21,00 and the annealing time was substantially lessened. Accordingly, polymer shaving a number average molecular weight of approximately 15,000 to 30,000 and particularly 20,000 to 25,000 provide unexpectedly fast annealing, to produce conductive PTC compounds having a sharp rise in resistance at a predetermined upper temperature limit for self-regulating wire.

The number average molecular weight ($\overline{M}n$) of the paraffin used in loading the PTC compound was smaller than that of the Epolene polyethylene. The $\overline{M}n$ value of the paraffin was approximately 2,500.

In accordance with an important feature of the present invention, it has been found that annealing can be essentially eliminated by loading a semi-crystalline polymer with low molecular weight molecules having a molecular weight in the range of 1,000 to 30,000, particularly in the range of 5,000 to 23,000 and especially about 10,000 to 20,000. It has been found that a percentage of at least about 9%, based on the total polymer weight in the composition of the low molecular weight molecules will actually eliminate the need for thermal structuring (annealing).

Nothing in this disclosure should be interpreted to mean that the higher molecular weight polymer molecules are not necessary, but their contribution is in the area of physical properties (material strength) and not electrical conductivity.

Union Carbide DFD 6005 polyethylene was loaded with low molecular weight polyethylenes to increase the percentage of low molecular weight molecules in the polyethylene and lower the number average molecular weight of the polymer. The purpose of these experiments was to verify the new and unexpected findings that polymers having a sufficient number of relatively small molecular weight molecules exhibited PTC behavior with very little or no annealing.

The composite matrix materials of the follow example were manufactured by combining, in a Banbury mixer, the following components;

EXAMPLE 1

| | |
|---|---|
| Carbon Black (Regal 660) | 14.4% by weight |
| Alumina Trihydrate | 18.0% by weight |
| DFD 6005 Polyethylene | 43.2% by weight |
| Low Molecular Weight Polyethylene ($\overline{M}_w$= 24,000; $\overline{M}_n$= 8,000) | 10.0% by weight |

-continued

| | |
|---|---|
| Copolymer (Ethylene Ethylacrylate) | 14.4% by weight |

Figure 4:
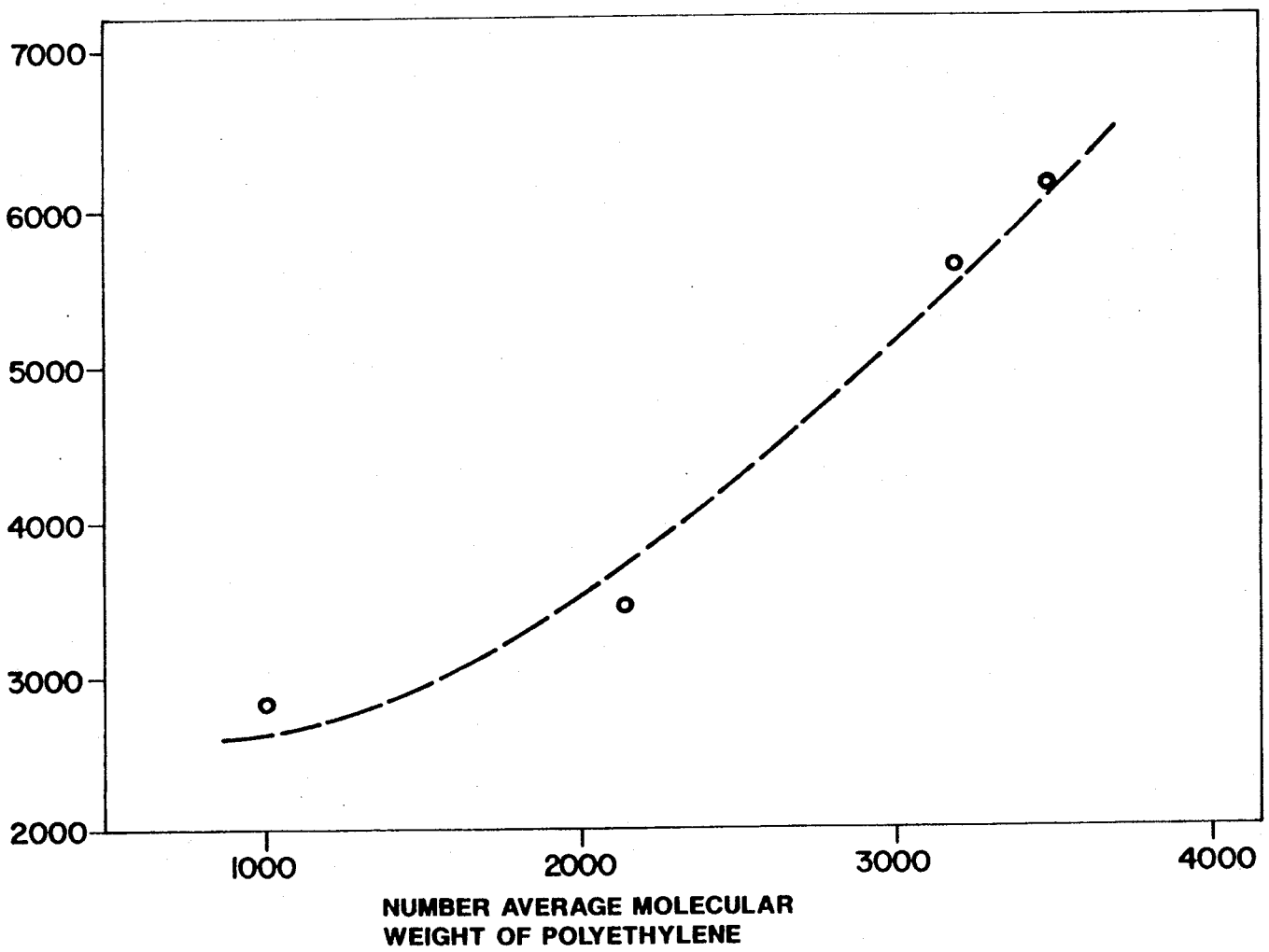
FIG. 4 is a graph of volume resistivity vs. number average molecular weight for various polyethylenes.

The carbon black was first mixed into the ethylene ethylacrylate copolymer before mixing with the other components. These materials were then granulated and plaques were pressed around a pair of electrodes at 350° F. and 1500 p.s.i.g. for three minutes. The plaques then were used to measure the volume resistivity of the final compounds. Table I and FIG. 4 presents in tabular and graphic form the resulting data. It should be noted that the control sample identified as Union Carbide 6005 was manufactured in accordance with the above composition, except using an additional 10% Union Carbide 6005 instead of the low molecular weight polyethylene.

It can be seen from the data of Table I that the addition of low molecular weight species to the Union Carbide DFD 6005 polyethylene substantially lowers the volume resistivity (increased the conductivity). Compositions made with pure Union Carbide DFD 6005 require 1 to 3 minutes to anneal, while compositions made with pure 310-06 polyethylene will anneal in 250 milliseconds between the extruder cross head and cooling water trough.

TABLE I

MOLECULAR WEIGHT/RESISTIVITY CORRELATION

| Compound | $M_n$ | Volume Resistivity |
|---|---|---|
| 6005 (control) | 34,800 | 6154 ohm-cm. |
| 10% Epolene C-14 | 31740 | 5610 ohm-cm. |
| 10% Epolene C-10 | 21356 | 3462 ohm-cm. |
| 10% Paraffin | 10,000 | 2805 ohm-cm. |

The data of Table II were taken from experimental PTC compositions the same as Example 1, except containing USA 310-06 low density polyethylene having a $\overline{M}_w$ of about 150,000 and a $\overline{M}_n$ of about 23,000, instead of the DFD 6005 polyethylene. The quenching or cooling water temperature was 23° C. Line speed is the speed of the finished extrusion wire as it leaves the extruder crosshead on route to the quenching water trough. The quench distance is the distance from the die exit of the extruder to the contact point of water in the cooling water trough. The current is the room temperature current of the wire taken immediately from the water trough.

TABLE II

NON-ANNEALING QUENCHING EVALUATION

| SAMPLE # | LINE SPEED (ft/min) | QUENCH DISTANCE (inches) | CURRENT (mA) |
|---|---|---|---|
| 1 | 1000 | 54 | 170 |
| 2 | 750 | 54 | 159 |
| 3 | 750 | 67 | 163 |
| 4 | 1000 | 8.5 | 144 |

The above data teaches that annealing times of only 42.5 milliseconds (sample #4) produces a conductive PTC composition provided that the polymer and carbon black meet the criteria of the composition of the present invention.

To evaluate better the effects of low molecular weight molecules in PTC polymer compositions, polyethylene having a molecular weight distribution of 1500 to 26,000 was added in varying amounts to a PTC composition, as shown in Examples 2–7:

EXAMPLES 2–7

| | 2 | 3 | 4 | 5 | 6 | 7 |
|---|---|---|---|---|---|---|
| Carbon Black (Regal 660) | 20.0 | 20.0 | 20.0 | 20.0 | 20.0 | 20.0 |
| Copolymer (Ethylene Ethylacrylate) | 20.0 | 20.0 | 20.0 | 20.0 | 20.0 | 20.0 |
| DFD 6005 Polyethylene | 60.0 | 58.5 | 57.1 | 55.6 | 54.1 | 52.7 |
| Low Molecular Weight Polyethylene ($\overline{M}_w$= 24,000; $\overline{M}_n$= 8,000) | 0.0 | 1.5 | 2.9 | 4.4 | 5.9 | 7.3 |

Figure 5:
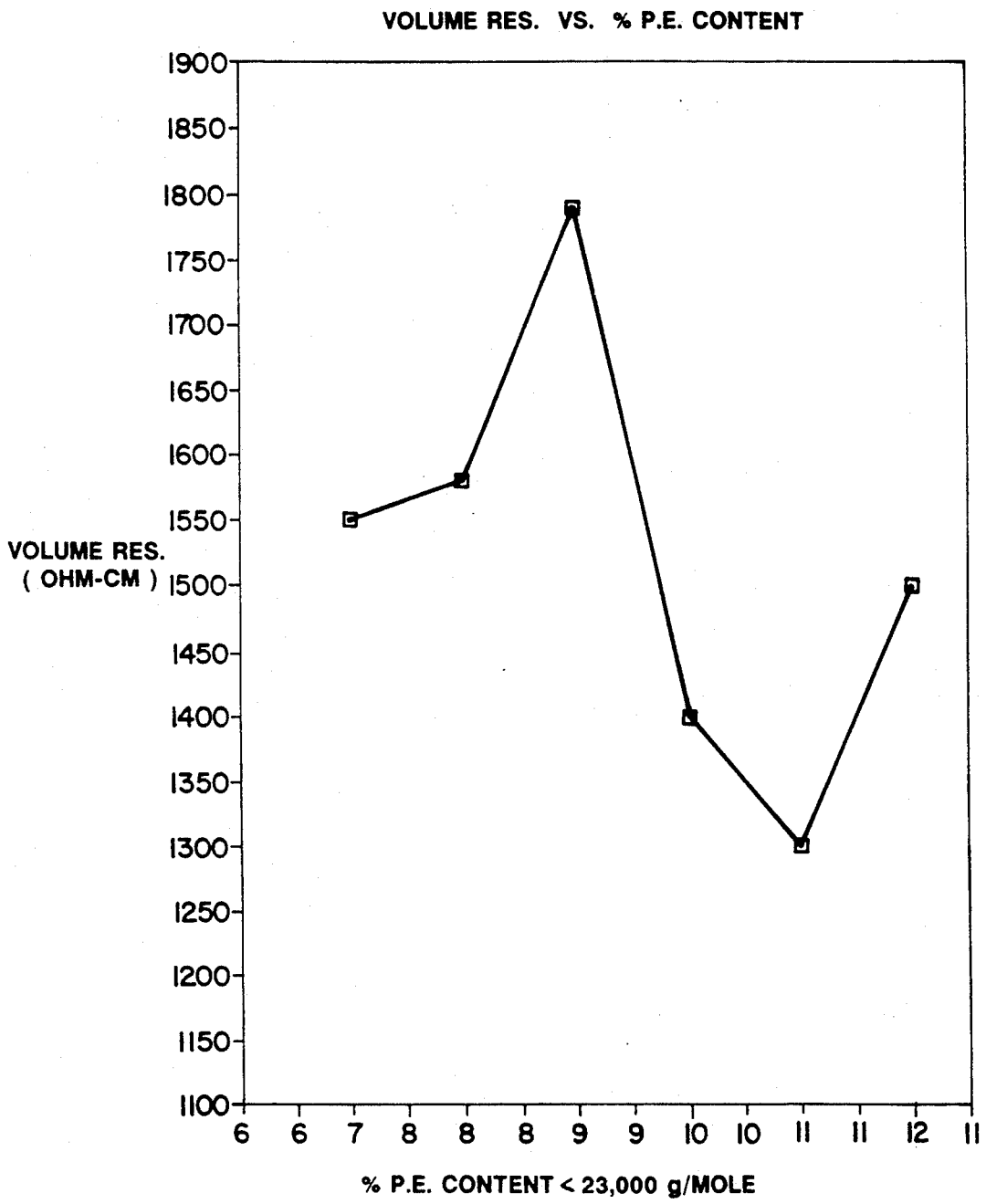

The compositions of Examples 2–7 are granulated and plaques were pressed around a pair of electrodes at 350° F. and 1500 psig for three minutes. These plaques were then used to measure the volume resistivity of the final compounds. Table III and FIG. 5 presents in tabular and graphical form the resultant data. It should be noted that the control sample, identified as Example 2, was manufactured without the addition of low molecular weight polyethylene molecules (copolymer and DFD 6005 polyethylene only). The purpose of using the control sample, made in exactly the manner described, is to compare the effects of various levels of doping or addition of low molecular weight molecules to the PTC composition.

It can be seen from Table III that no drop in volume resistivity of the PTC compound occurred until the percentage of polyethylene molecules present in the molecular weight fraction less than 23,000 had been altered to more than a 9% level, and generally at least about a 10% level. At an 11% level the volume resistivity of the compound dropped even lower, but began to rise when doped to a 12% level. This suggests that a saturation of low molecular weight molecules in a specific molecular weight region of the molecular weight distribution can occur, and additional doping with low molecular weight molecules will not enhance the conductive characteristics of the compound.

TABLE III

VOLUME RESISTIVITY VS. PERCENT POLYETHYLENE MOLECULES HAVING A MOLECULAR WEIGHT LESS THAN 23,000

| Example No. | % P.E. Molecules having a M.W. <23,000 | Volume Resistivity |
|---|---|---|
| 2 (control) | 7% | 1550 ohm-cm. |
| 3 | 8% | 1580 ohm-cm. |
| 4 | 9% | 1790 ohm-cm. |
| 5 | 10% | 1400 ohm-cm. |
| 6 | 11% | 1300 ohm-cm. |
| 7 | 12% | 1500 ohm-cm. |

Recent experiments were conducted with Eastman's Tenite 800 low density polyethylene. Molecular weight characteristics are listed below.

| | Molecular Weights | | Polydispersity |
|---|---|---|---|
| | $\overline{M}_w$ | $\overline{M}_n$ | $M_w/M_n$ |
| Tenite 800 | 215,000 | 26,300 | 8.20 |
| Tenite 800 | 215,000 | 22,900 | 9.41 |
| USI 310-06 | 150,000 | 22,600 | 6.62 |

-continued

| | Molecular Weights | | Polydispersity |
|---|---|---|---|
| | $\overline{M}_w$ | $\overline{M}_n$ | $M_w/M_n$ |
| USI 310-06 | 150,000 | 23,400 | 6.67 |

Volume resistivity results from compounds made with this low density polyethylene having a weight average molecular weight ($\overline{M}_w$) of about 215,000 indicate that while the low molecular weight fractions of this polyethylene are similar to that of USI's 310-06, and therefore should not significantly change the annealing characteristics of the PTC compound, the much larger weight average molecular weight ($\overline{M}_w$) of Tenite 800, compared to that of USI's 310-06 causes crystallization problems requiring annealing. This large difference in weight average molecular weight indicates that Tenite 800 possesses a greater distribution of higher molecular weight molecules (>500,000 g/mole) than 310-06 polyethylene. These higher molecular weight molecules inhibit rapid crystal formation by creating a more viscous melt. This viscous melt reduces molecular mobility and thus the ability of the small molecular weight molecules to properly align for rapid crystallization. As a result, thee exists a maximum, allowable weight average molecular weight for low density polyethylenes which can be successfully used in essentially nonannealing PTC formulations. This weight average molecular weight upper limit can be defined as approximately 200,000. From this definition a polydispersity ($\overline{M}_w/\overline{M}_n$) range for low density polyethylenes can then be set from 3.0 to 25.0. To achieve the full advantage of the present invention, the polydispersibility should be less than 10 and preferably 5–8. Wile polydispersities of 10 to 25 provide marked improvements in accordance with the present invention, crystallization proceeds more slowly than polymer compositions having a semicrystalline polymer with a polydispersibility of 3 to less than 10 and especially 6–7.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A method of manufacturing a polymeric composition capable of exhibiting PTC behavior having an essentially stable and constant conductivity essentially without annealing comprising mixing together a first semicrystalline polymer; 4 to 25% by weight of the composition of carbon black and a sufficient amount of a second semicrystalline polymer having a sufficient number of molecules of a molecular weight of 40,000 or less to substantially eliminate an annealing period necessary to achieve an electrically conductive material exhibiting PTC behavior.

2. The method of claim 1 wherein the polymer molecules in the second semicrystalline polymer are predominantly in the molecular weight range of 1,000 to 30,000.

3. The method of claim 2 wherein the second semicrystalline polymer comprises molecules predominantly in the molecular weight range of 5,000 to 15.000.

4. The method of claim 1 wherein the first semicrystal polymer comprises a polymer having a weight average molecular weight above 200,000 and wherein the second semicrystalline polymer includes a sufficient number of low molecular weight molecules such that the combined semicrystalline polymers have a weight average molecular weight of 200,000 or less, a number average molecular weight less than 30,000, and a polydispersibility of 3–25.

5. A method of manufacturing a polymeric composition having an essentially stable and constant conductivity essentially without annealing prior to crosslinking the polymer comprising mixing together a first semicrystalline polymer and 4% to 25% by weight of the composition of carbon black wherein said first semicrystalline polymer has an insufficient number of low molecular weight polymer molecules to provide a polymer composition capable of exhibiting PTC behavior and reaching an essentially stable and constant conductivity essentially without annealing; and adding a second semicrystalline polymer to said polymer composition, said second polymer added to said composition in an amount sufficient to essentially eliminate an annealing period necessary to achieve an electrically conductive material exhibiting PTC behavior.

6. The method of claim 5 wherein said first polymer is a polyolefin and said second polymer is a polyolefin or a wax.

7. The method of claim 5 wherein said first semicrystalline polymer provides less than 9% by weight of the total polymer molecules of the polymer composition in the molecular weight range of 1,000 to 30,000 and said second polymer is added in an amount sufficient to raise the percentage of semicrystalline polymer molecules having a molecular weight in the range of 1,000 to 30,000 to at least 9% based on the total weight of polymer in the composition.

8. The method of claim 7 wherein the second semicrystalline polymer is added in an amount sufficient to raise the percentage of semicrystalline polymer molecules within the molecular weight range of 5,000 to 23,000 to at least 9% by weight of total polymer molecules in the composition.

9. The method of claim 8 wherein the second semicrystalline polymer is added in an amount sufficient to raise the percentage of semicrystalline polymer molecules within the molecular weight range of 10,000 to 20,000 to at least 9% by weight of total polymer molecules in the composition.

10. The method of claim 5 wherein the weight average molecular weight of the semicrystalline polymers in the composition is 200,000 or less.

11. The method of claim 7 wherein the weight average molecular weight of the semicrystalline polymers in the composition is 200,000 or less.

12. The method of claim 8 wherein the weight average molecular weight of the semicrystalline polymers in the composition is 200,000 or less.

13. The method of claim 9 wherein the weight average molecular weight of the semicrystalline polymers in the composition is 200,000 or less.

14. The method of claim 5 further including adding a third polymer to the composition, said third polymer having one or more polar groups in an amount of at least 2% by weight of the composition.

* * * * *